US010343397B2

(12) United States Patent
MacKenzie et al.

(10) Patent No.: US 10,343,397 B2
(45) Date of Patent: Jul. 9, 2019

(54) PRINTER CARTRIDGE WITH MULTIPLE FLUID CHAMBERS IN FLUID COMMUNICATION

(71) Applicant: HEWLETT-PACKARD DEVELOPMENT COMPANY, L.P., Houston, TX (US)

(72) Inventors: Mark H. MacKenzie, Corvallis, OR (US); Garrett E. Clark, Corvallis, OR (US); Michael W. Cumbie, Albany, OR (US)

( * ) Notice: Subject to any disclaimer, the term of this patent is extended or adjusted under 35 U.S.C. 154(b) by 0 days.

(21) Appl. No.: 15/765,902

(22) PCT Filed: Oct. 28, 2015

(86) PCT No.: PCT/US2015/057764
§ 371 (c)(1),
(2) Date: Apr. 4, 2018

(87) PCT Pub. No.: WO2017/074339
PCT Pub. Date: May 4, 2017

(65) Prior Publication Data

US 2018/0281400 A1 Oct. 4, 2018

(51) Int. Cl.

| | |
|---|---|
| ***B41J 2/055*** | (2006.01) |
| ***B41J 2/175*** | (2006.01) |
| *B41J 2/14* | (2006.01) |

(52) U.S. Cl.
CPC ..... *B41J 2/055* (2013.01); *B41J 2/175* (2013.01); *B41J 2/17513* (2013.01); *B41J 2/17556* (2013.01); *B41J 2/17596* (2013.01); *B41J 2002/14459* (2013.01)

(58) Field of Classification Search
CPC .... B41J 2/175; B41J 2/17513; B41J 2/17523; B41J 2/17556; B41J 2/17596; B41J 2/055; B41J 2002/1445
See application file for complete search history.

(56) References Cited

U.S. PATENT DOCUMENTS

| | | | | |
|---|---|---|---|---|
| 4,509,062 A * | 4/1985 | Low | B41J 2/175 347/56 |
| 5,430,471 A * | 7/1995 | Nakajima | B41J 2/17513 347/87 |
| 5,936,650 A | 8/1999 | Ouchida et al. | |
| 6,164,772 A * | 12/2000 | Koitabashi | B41J 2/17513 347/100 |

(Continued)

FOREIGN PATENT DOCUMENTS

| | | |
|---|---|---|
| CN | 103282209 | 9/2013 |
| CN | 104053548 | 9/2014 |

(Continued)

*Primary Examiner* — Anh T Vo
(74) *Attorney, Agent, or Firm* — Fabian VanCott

(57) ABSTRACT

In one example in accordance with the present disclosure a printer cartridge is described. The printer cartridge includes at least one backpressure chamber to provide backpressure to a fluid during deposition of the fluid onto a print medium. The printer cartridge also includes multiple fluid chambers in fluid communication with the at least one backpressure chamber. A fluid chamber provides fluid to a portion of a printhead. Adjacent fluid chambers are selectively in fluid communication with one another via valves.

20 Claims, 6 Drawing Sheets

(56) References Cited

U.S. PATENT DOCUMENTS

| | | | | |
|---|---|---|---|---|
| 6,250,747 | B1 * | 6/2001 | Hauck | B41J 2/17556 347/86 |
| 6,773,097 | B2 | 8/2004 | Dowell | |
| 7,048,353 | B2 | 5/2006 | Waller et al. | |
| 7,628,475 | B2 | 12/2009 | Langford et al. | |
| 8,348,406 | B2 | 1/2013 | Park | |
| 9,039,148 | B2 * | 5/2015 | Murphy | B41J 2/17513 347/85 |
| 2003/0043240 | A1 | 3/2003 | Dowell | |
| 2004/0169706 | A1 | 9/2004 | Slotto | |
| 2007/0200902 | A1 | 8/2007 | Eve | |
| 2008/0043075 | A1 | 2/2008 | Langford | |
| 2008/0218566 | A1 * | 9/2008 | Malik | B41J 2/17556 347/86 |
| 2009/0021542 | A1 | 1/2009 | Kanfoush et al. | |
| 2010/0079559 | A1 | 4/2010 | Justice et al. | |
| 2011/0025786 | A1 | 2/2011 | Price | |
| 2012/0026255 | A1 | 2/2012 | Park | |
| 2013/0141497 | A1 | 6/2013 | Boyd et al. | |
| 2015/0035915 | A1 | 2/2015 | Murphy et al. | |

FOREIGN PATENT DOCUMENTS

| | | |
|---|---|---|
| EP | 1287999 | 3/2003 |
| JP | 2004042524 | 2/2004 |
| JP | 2006312291 | 11/2006 |
| WO | WO-2008130928 | 10/2008 |
| WO | WO-2009005765 | 8/2009 |
| WO | WO-2012094018 | 7/2012 |

* cited by examiner

PRINTER CARTRIDGE WITH MULTIPLE FLUID CHAMBERS IN FLUID COMMUNICATION

BACKGROUND

Printing systems are used to deposit printing fluid such as ink, onto a print medium such as paper. Fluid containers such as printer cartridges store the fluid that is used by other devices, such as printheads. A fluid delivery system transports the printing fluid from the fluid container to the printhead. The printhead of the printing system is a device of a printing system that deposits the ink or other printing fluid onto the print medium.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
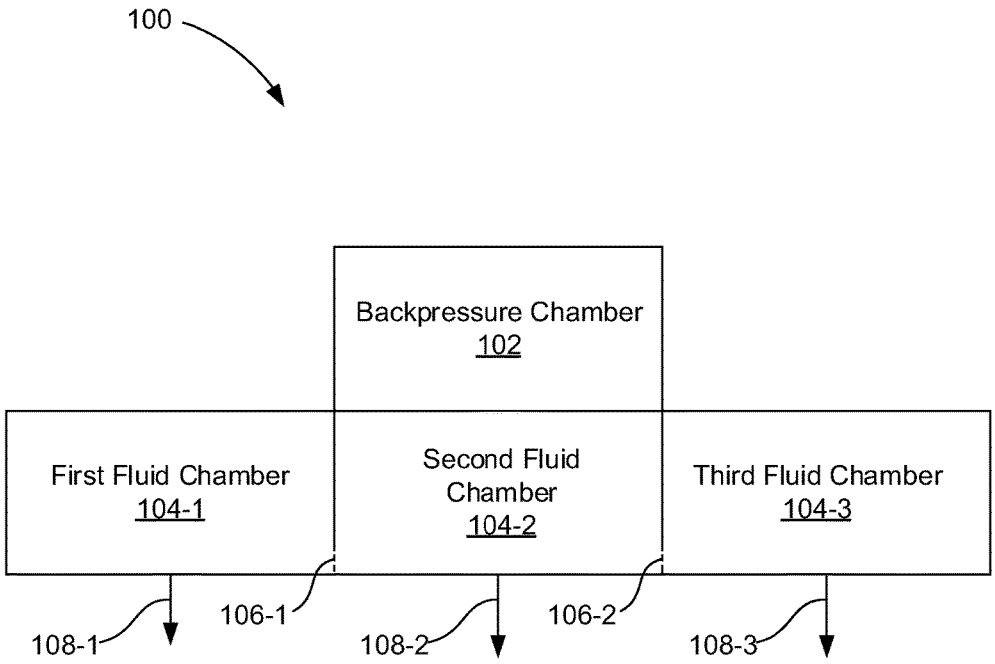
FIG. 1 is a block diagram of a printer cartridge with multiple fluid chambers in fluid communication, according to one example of the principles described herein.

As described above, printer cartridges store fluid, such as ink that is to be supplied to other devices and which fluid is ultimately deposited on print media. A printhead is an example of a device that is use to deposit ink, or other printing fluid onto print media such as paper. Such printheads include dies that have openings through which the printing fluid passes from the printing system onto the paper. Prior to ejection a small amount of printing fluid resides in a firing chamber of the printhead die and an ejector such as a thermo-resistor or a piezo-resistive device creates pressure that forces a portion of the printing fluid from the firing chamber, through the opening, and onto the print media. One particular type of printhead is a page wide printhead where an array of printhead dies spans the printing width of the print media. In some examples a fluid delivery system of a printer cartridge may include a fluid chamber that supplies the fluid to the printhead. While such printing systems are efficient in depositing ink, or other printing fluid, onto print media, some environments do not lend well to existing printing systems.

For example, as printing fluid is used, it is depleted from a fluid chamber and replaced with air. Due to changes in temperature and pressure, the air can expand and push ink out of the nozzles. To regulate this, a backpressure chamber may be used to prevent such drool. However, backpressure chambers suffer from some limitations. These limitations are exacerbated when a printer cartridge is the same width as the page to be used with a page wide printhead. For example, due to its length, a page wide printhead, and a corresponding page wide printer cartridge are both subject to greater head pressure due to the height of the page wide printer cartridge. In one example, this may be most evident when a page wide printer cartridge is tipped on its side. Some printer cartridges attempt to accommodate this increased head pressure by using foams with smaller pore size to regulate backpressure. However, foams with such a smaller pore size reduce the flow rates and may filter pigments and other solid particles within the print fluid.

Other printer cartridges include separate backpressure chambers and fluid chambers for different sets of printhead dies or fluid colors. However, in so doing each of the different fluid chambers may be drained of ink at different rates. For example, in a single color page wide array those fluid chambers that are near the center of a page may be more used, and therefore drained more quickly than fluid chambers near the peripheries of the printer cartridge. Such uneven printing may result in some fluid chambers being depleted before others. This may lead to wasted fluid usage as a printer cartridge may be discarded when a user determines one fluid chamber is depleted even though fluid may be present in other chambers. Still further, uneven fluid chamber depletion may result in uneven printing as a portion of a page may not receive adequate fluid while other portions may receive sufficient fluid. Such uneven printing may result in unacceptable image quality.

The present specification describes a printer cartridge that contains at least one backpressure chamber and multiple fluid chambers, each fluid chamber is in fluid communication with the at least one backpressure chamber. Adjacent fluid chambers are selectively in fluid communication with one another such that the available fluid and/or pressure in each of the fluid chambers may be kept more consistent. More specifically, each fluid chamber includes valves that open to allow fluid to flow between adjacent fluid chambers. In some examples, the pressure and fluid level are coupled and a pressure difference between the two is used to maintain the fluid levels relative to one another. In some examples, the valve opens when pressure differences between adjacent fluid chambers reaches a threshold level. With the valve open, fluid may flow freely between adjacent fluid chambers to balance the available fluid and/or pressure between adjacent fluid chambers. Once the available fluid and pressures are relatively balanced, the valve closes.

Specifically, the present specification describes a printer cartridge. The printer cartridge includes at least one backpressure chamber to provide backpressure to a fluid during deposition of the fluid onto a print medium and multiple fluid chambers in fluid communication with the at least one backpressure chamber. A fluid chamber provides a fluid to a portion of a printhead. Adjacent fluid chambers are selectively in fluid communication with one another via valves that are opened. For example, the fluid chambers may at some points be in fluid communication with one another and at other points may not be in fluid communication with one another. As a specific example, when a pressure differential between adjacent fluid chambers is greater than a certain threshold, the valves may open and the adjacent fluid chambers are in fluid communication with one another. However, when the pressure differential is not greater than the certain threshold, the valves are closed and the adjacent fluid chambers are not in fluid communication with one another.

The present specification also describes a fluid delivery system that includes at least one backpressure chamber to provide backpressure to a fluid during deposition of the fluid onto a print medium and multiple fluid chambers. Each fluid chamber is in fluid communication with the at least one backpressure chamber. A fluid chamber includes at least one passageway connecting the fluid chamber to adjacent fluid chambers. In a passageway, a valve regulates fluid flow between adjacent fluid chambers. The fluid delivery system also includes a printhead to transfer the fluid from the multiple fluid chambers onto a print medium.

The present specification also describes a printer cartridge that includes multiple backpressure chambers to provide backpressure to the fluid during deposition of the fluid onto a print medium and multiple fluid chambers. Each of the fluid chambers is in fluid communication with one of the multiple backpressure chambers and provides fluid to a printhead. Each of the fluid chambers includes a first passageway and valve to selectively allow fluid flow in a first direction between adjacent fluid chambers and a second passageway and valve to selectively allow fluid flow in a second direction between adjacent fluid chambers. In other words, selectively allowing fluid flow indicates that the valve and passageway may either allow fluid flow or block fluid flow at different points in time. At least one of an array of the multiple backpressure chambers and an array of the multiple fluid chambers are the same width as a print medium.

Certain examples of the present disclosure are directed to printer cartridges and fluid delivery systems that have fluid chambers that are in fluid communication with adjacent fluid chambers that provides a number of advantages not previously offered including 1) accommodating greater head pressures found in certain print heads; 2) allowing for larger fluid container design; and 3) reducing stranded fluid caused by uneven printing along a page wide print head. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

As used in the present specification and in the appended claims, the term "backpressure" or similar terminology refers to a negative pressure relative to ambient that retains a printing fluid within a fluid chamber and prevents the printing fluid from being dispelled from a nozzle.

As used in the present specification and in the appended claims, the term "shared" refers to a fluid chamber that supplies fluid to multiple backpressure chambers.

Further, as used in the present specification and in the appended claims, the term "free" or similar terminology refers to fluid that is not subject to an imposed pressure.

Still further, as used in the present specification and in the appended claims, the term "breaking pressure" refers to a pressure at which a valve is opened. When a pressure is greater than the breaking pressure, the valve opens, and when the pressure reduces below the breaking pressure for the valve, the valve closes.

Even further, as used in the present specification and in the appended claims, the term "head pressure" refers to a backpressure within a fluid chamber that prevents drool, or undesirable leakage of a printing fluid from a nozzle.

Yet further, as used in the present specification and in the appended claims, the term "a number of" or similar language is meant to be understood broadly as any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language indicates that a particular feature, structure, or characteristic described in connection with that example is included as described, but may not be included in other examples.

Turning now to the figures, FIG. 1 is a block diagram of a printer cartridge (100) with multiple fluid chambers (104) in fluid communication, according to one example of the principles described herein. As described above a printer cartridge (100) is used to supply fluid to a device that expels the fluid onto print media. For example, the fluid may be ink and the printer cartridge (100) may be an inkjet cartridge that supplies the ink to a printhead which printhead deposits the ink onto print media to form text or images. The printer cartridge (100) is usable in an image forming device such as a printer.

The printer cartridge (100) includes at least one backpressure chamber (102). The backpressure chamber (102) provides backpressure to fluid in the fluid chambers (104) to prevent fluid from leaking and drooling out of the nozzles. Specifically, the backpressure chamber (102) provides backpressure to the nozzles of the fluidic ejection assembly during deposition of fluid onto a print medium. The backpressure chamber (102) also prevents fluid from dripping out the nozzles when the image forming apparatus is not operating. The backpressure provided by the backpressure chamber (102) is a negative pressure relative to ambient pressure.

Figure 5:
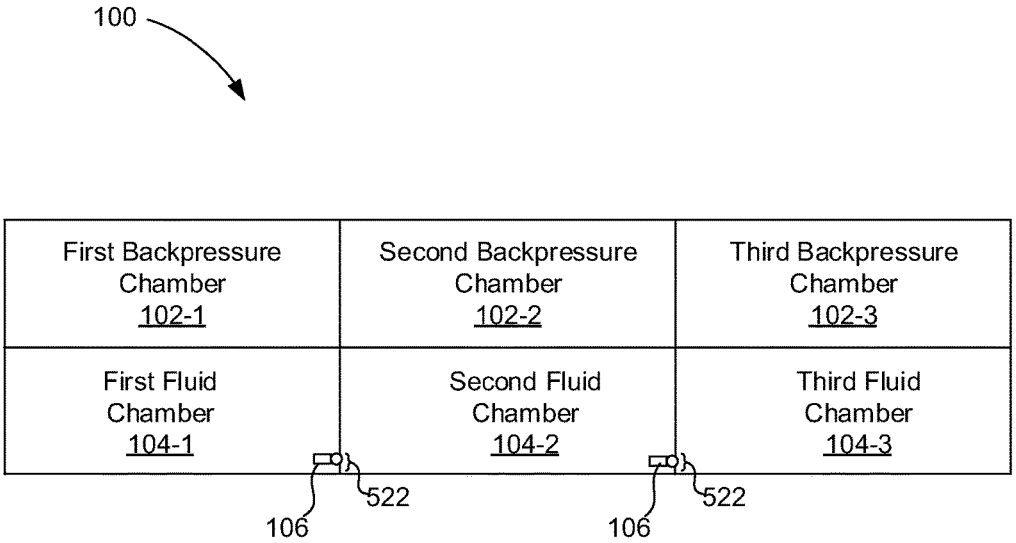
FIG. 5 is a diagram of a printer cartridge with multiple fluid chambers in fluid communication, according to another example of the principles described herein.

In some examples, the system (100) includes a single backpressure chamber (102) in direct fluid communication with the second fluid chamber (104-2). In this example, the valve(s) (106-1) between the first fluid chamber (104-1) and the second fluid chamber (104-2) and the valve(s) (106-2) between the third fluid chamber (104-3) and the second fluid chamber (104-2) regulate fluid flow from the second fluid chamber (104-2) into the first fluid chamber (104-1) and the third fluid chamber (104-3), respectively. Accordingly, in the case of a single backpressure chamber (102), some of the fluid chambers (104), such as the second fluid chamber (104-2), may be in direct fluid communication with the backpressure chamber (102) while others, such as the first fluid chamber (104-1), and the third fluid chamber (104-3) may be in indirect fluid communication with the backpressure chamber (102) via another fluid chamber. While FIG. 1 depicts a single backpressure chamber (102), in some examples as depicted in FIG. 5, the cartridge (100) may include multiple backpressure chambers (102).

The printer cartridge (100) also includes multiple fluid chambers (104-1, 104-2, 104-3) that are in fluid communication with the at least one backpressure chamber (102). As used in the present specification, the identifier "-*" refers to a specific instance of an element. For example (104-1) refers to a first fluid chamber (104-1). By comparison, elements without the identifier "-1" refer to a generic instance of an element. For example, (104) refers to fluid chamber in general. The fluid chambers (104) are chambers where fluid is allowed to flow freely within. For example, there is no component that restricts movement of fluid within the fluid chamber (104).

The fluid chambers (104) provide an amount of fluid to a portion of a printhead. For example, when used in an image forming apparatus, the printer cartridge (100) may be placed in fluid communication with a fluid ejection assembly such as a printhead. The printhead includes a number of components to deliver ink onto a print medium. For example a printhead includes printhead dies which each include nozzles to deposit an amount of fluid onto the print medium. In this example, each fluid chamber (104) supplies fluid to different printhead die(s) of the printhead. For example, the first fluid chamber (104-1) supplies fluid to a first set of printhead die(s) as indicated by the arrow (108-1) which first set may include any number starting from and including one. Similarly, the second fee fluid chamber (104-2) and the third fluid chamber (104-3) supply fluid to a second set of printhead die(s) and a third set of printhead die(s) as indicated by the arrows (108-2) and (108-3), respectively. The fluid chambers (104) may be arranged in an array, and the array may span the width of the print medium. For example, if the print medium is 8.5 in.×11 in. paper, the array of fluid chambers (104) may be 8.5 in. wide.

Adjacent fluid chambers (104) may be in selective fluid communication with one another. For example, if the available fluid levels and/or pressure are different in different fluid chambers (104), a valve (106-1, 106-2) may be opened to allow fluid to flow from a fluid chamber (104) with more fluid to a fluid chamber (104) with less fluid.

The valve (106) may be opened and closed using different criteria. For example, the valves (106) may be opened and closed via pressure differentials between adjacent fluid chambers (104). For example, if the first fluid chamber (104-1) has more available fluid than the second fluid chamber (104-2) a pressure differential exists between the two that would activate the valve (106-1) to allow fluid to flow from the first fluid chamber (104-1) to the second fluid chamber (104-2) to balance the available fluid levels in each chamber.

While FIG. 1 depicts certain numbers of backpressure chambers (102) and fluid chambers (104) any number of these components may be present in the printer cartridge (100). Specifically, while FIG. 1 depicts one backpressure chamber (102) and three fluid chambers (104), the cartridge (100) may include any number of backpressure chambers (102) and fluid chambers (104). For example, the system could include two backpressure chambers (102) and two fluid chambers (104).

The backpressure chamber (102) and the fluid chambers (104) that are in selective fluid communication with one another allow for the proper degree of backpressure to prevent nozzle drip, while still allowing for adequate print quality and also alleviating the undesirable consequences of fluid chambers (104) with different available printing fluid levels. For example, at the beginning of life of the printer cartridge (100) the fluid chambers (104) may have approximately the same amount of fluid available to the corresponding printhead dies. However, upon the end of life, without the fluidly communicated fluid chambers (104), uneven distribution of fluid within the fluid chambers (104) may result in uneven printing. By allowing ink to flow between the fluid chambers (104), an even distribution of the available fluid within the fluid chambers (104) is maintained, thus reducing uneven fluid levels and uneven printing.

Figure 2:
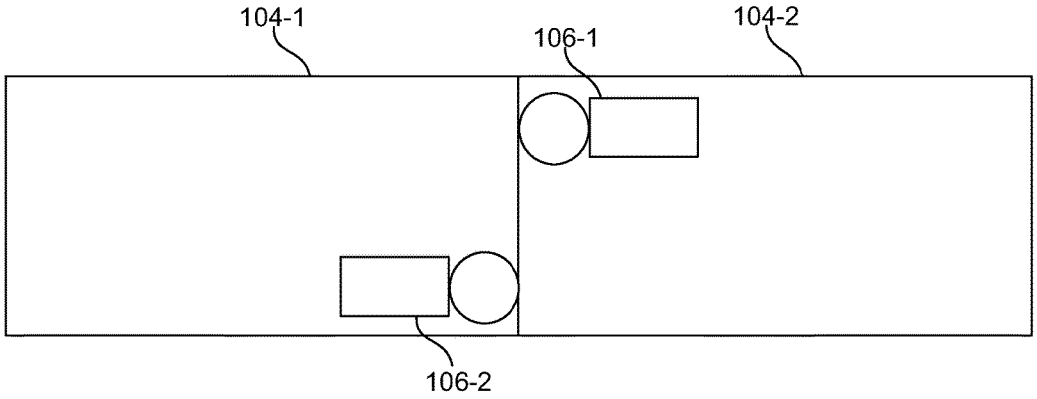
FIG. 2 is a top cross-sectional view of two fluid chambers in fluid communication, according to one example of the principles described herein.

FIG. 2 is a top cross-sectional view of two fluid chambers (104-1, 104-2) in fluid communication, according to one example of the principles described herein. As FIG. 1 is a front view, one valve (106) is depicted between a pair of adjacent fluid chambers (104-1, 104-2). However, between adjacent fluid chambers (104-1, 104-2) multiple valves (106-1, 106-2) may be present as depicted in FIG. 2. The valves (106) may be one-way valves that allow fluid flow in one direction while preventing fluid flow in a second direction. While FIG. 2 depicts two valves (106), in some examples a single valve (106) may be implemented. For example, when using two valves (106-1, 106-2) the valves (106-1, 106-2) may be uni-directional valves. However, when using a single valve (106), the single valve (106) may be a bi-directional valve (106). Still further, the single valve (106) may also be a uni-directional valve (106) which would allow fluid flow in one direction.

Regarding the two valve example, in the situation where the backpressure in a first fluid chamber (104-1) is lower than the backpressure in a second fluid chamber (104-2) in an amount where the pressure difference between the two is greater than the breaking pressure of a first valve (106-1), the first valve (106-1) may open to allow fluid to flow from the first fluid chamber (104-1) into the second fluid chamber (104-2).

By comparison, where the backpressure in the second fluid chamber (104-2) is lower than the backpressure in the first fluid chamber (104-1) in an amount where the pressure difference between the two is greater than the breaking pressure of a second valve (106-2), the first valve (106-2) may open to allow fluid to flow from the second fluid chamber (104-2) into the first fluid chamber (104-1). More detail regarding the pressure differentials and fluid flow is described below in connection with FIGS. 3, 4A, and 4B.

Figure 3:
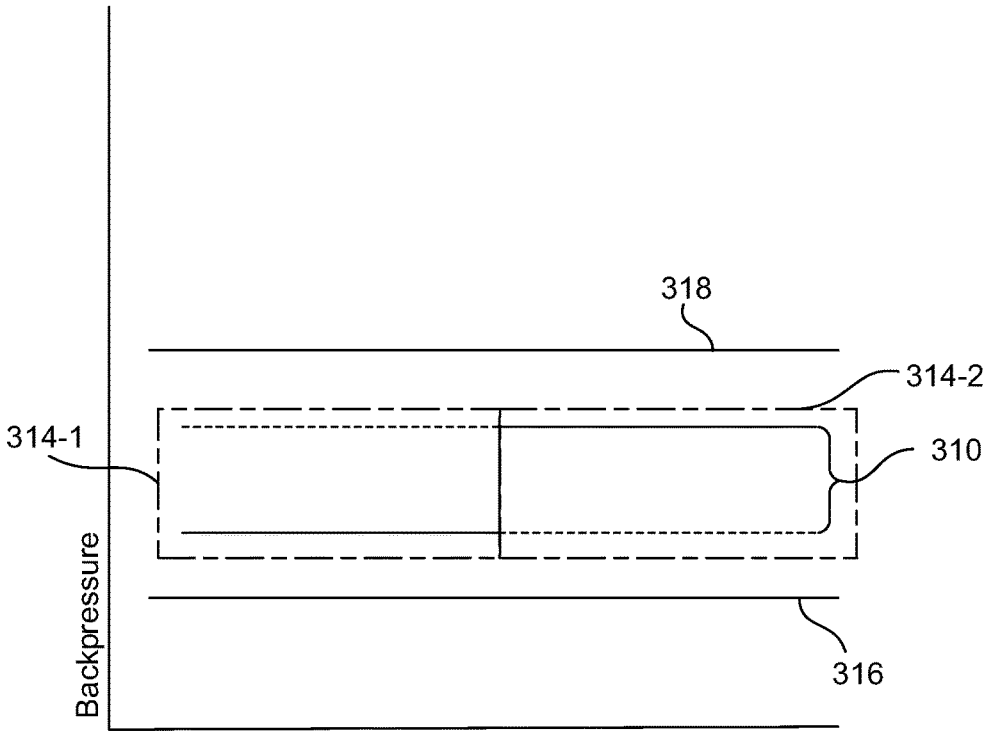
FIG. 3 is a chart showing the breaking pressure of a valve between two fluid chambers in fluid communication, according to one example of the principles described herein.

FIG. 3 is a chart showing the breaking pressure of a valve (FIG. 1, 106) between fluid chambers (FIG. 1, 104) in fluid communication, according to one example of the principles described herein. More specifically, FIG. 3 illustrates the different pressure difference states and corresponding fluid flows mentioned above. In the chart on FIG. 3, backpressure is indicated by the vertical axis. As mentioned above, backpressure is a negative pressure relative to ambient pressure. Accordingly, going vertical on the vertical axis indicates a backpressure that is "more negative" relative to a pressure lower on the chart. FIG. 3 depicts the backpressure of two different fluid chambers (FIG. 1, 104). Specifically, the left side (314-1) of the chart illustrates the backpressure of a first fluid chamber (FIG. 1, 104-1) and the right side (314-2) of the chart illustrates the backpressure of a second fluid chamber (FIG. 1, 104-2). As described above, as the pressure differential (310) is greater than a breaking pressure for the valve (FIG. 1, 106), the valve (FIG. 1, 106) opens such that fluid free flows between the two fluid chambers (FIG. 1, 104). The dotted line represents a pressure difference state in which fluid flows from the second fluid chamber (FIG. 1, 104-2) into the first fluid chamber (FIG. 1, 104-1) and the sold line represents a pressure difference state in which fluid flows from the first fluid chamber (FIG. 1, 104-1) into the second fluid chamber (FIG. 1, 104-2).

In some examples, the breaking pressure for a valve (FIG. 1, 106) may be such that the pressure in any of the multiple fluid chambers (FIG. 1, 104) is greater than a head pressure. A head pressure being the pressure that prevents fluid from leaking out the nozzle. More specifically, as depicted in FIG. 3, a head pressure (316) may exist and when the backpressure within a given fluid chamber (FIG. 1, 104) is less than the head pressure (316), fluid may drip out of the nozzle. Accordingly, as depicted in FIG. 3, the breaking pressure of the valve (FIG. 1, 106) may be such that the pressure in each fluid filled chamber (FIG. 1, 104) is not below the head pressure (316).

In some examples, the breaking pressure for a valve (FIG. 1, 106) may be such that the pressure in any of the multiple fluid chambers (FIG. 1, 104) is less than a bad print quality pressure (318). As used in the present specification a bad print quality pressure refers to a pressure wherein ink that resides in the fluid chamber (FIG. 1, 104) is prevented from exiting a fluidic ejection system. For example, during printing if the backpressure in a fluid chamber (FIG. 1, 104) is too great, the fluidic ejection system may not generate enough energy to overcome the backpressure to dispel the ink from the nozzle. Doing so results in misfires or non-fires of the droplet. This backpressure at which the fluidic ejection system cannot properly dispel fluid droplets may be referred to as a bad print quality pressure. Accordingly, as depicted in FIG. 3, the breaking pressure of the valve (FIG. 1, 106) may be such that the pressure in each fluid filled chamber (FIG. 1, 104) is not greater than the bad print quality pressure (318).

As a specific numeric example, the breaking pressure for the valve may have a pressure, measured in inches of water, of 3-5 inches of water. Such a value may be greater than the head pressure (316) and less than the bad print quality pressure (318). While specific reference is made to specific breaking pressures, the breaking pressure of a valve (FIG. 1, 106) depends upon the characteristics of the printer cartridge (FIG. 1, 100). For example, the desired backpressure generated in each backpressure chamber (FIG. 1, 102) may depend upon the number of backpressure chambers (FIG. 1, 102) and the width of the array of backpressure chambers (FIG. 1, 102). More specifically, the breaking pressure may be equal to the length of the printer cartridge (FIG. 1, 100) divided by the number of fluid chambers (FIG. 1, 104).

Figure 4A:
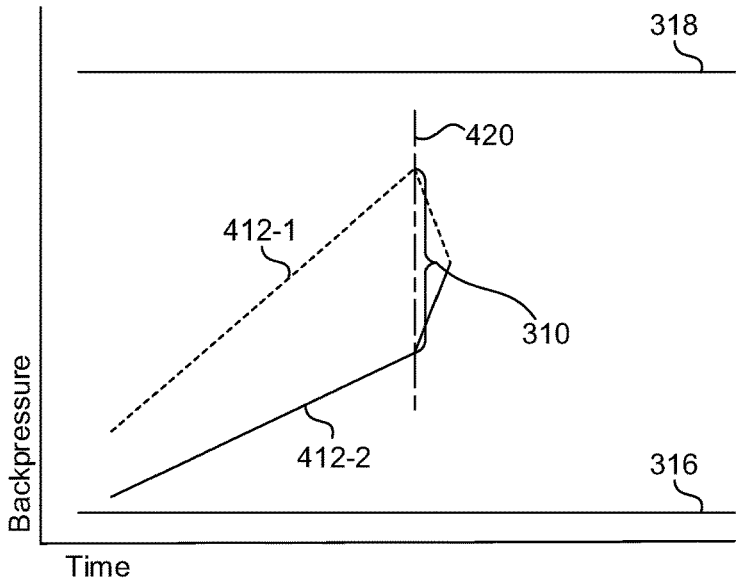
FIGS. 4A and 4B are charts showing possible pressure differences between two fluid chambers in fluid communication, according other examples of the principles described herein.
Figure 4B:
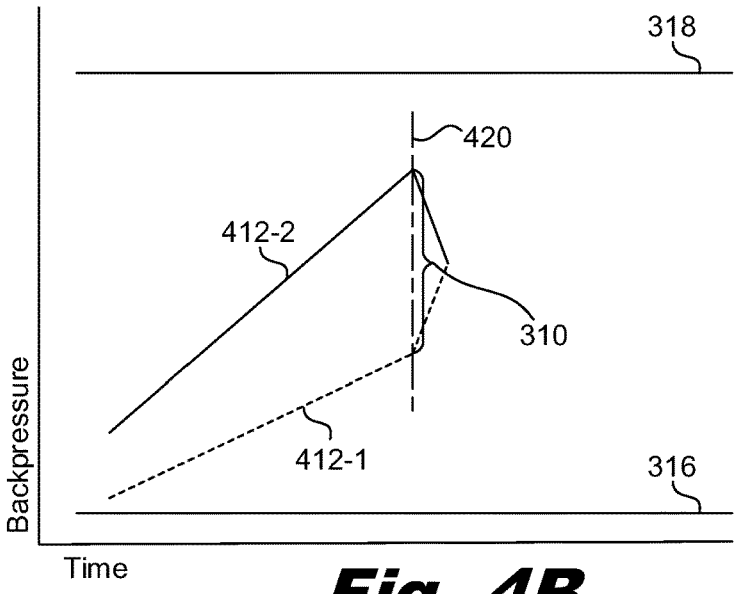

FIGS. 4*a* and 4*b* are charts showing the breaking pressure of valves (FIG. 1, 106) between fluid chambers (FIG. 1, 104) in fluid communication, according to another example of the principles described herein. In FIGS. 4A and 4B backpressure is measured along the vertical axis as a function of time along the horizontal axis. In FIG. 4A, the backpressure (412-1) of the first fluid chamber (FIG. 1, 104-1) is becoming more negative more quickly than the backpressure (412-2) of the second fluid chamber (FIG. 1, 104-2) resulting in an increasing pressure differential. As the pressure differential reaches a specific threshold (310), i.e., the breaking pressure of the valve (FIG. 1, 106), the valve (FIG. 1, 106) opens as indicated by the line (420) and fluid flows freely between the chambers and the pressure is equalized within the chambers (FIG. 1, 104-1, 104-2).

By comparison in FIG. 4B, the backpressure (412-2) of the second fluid chamber (FIG. 1, 104-2) is becoming more negative more quickly than the backpressure (412-1) of the first fluid chamber (FIG. 1, 104-1) resulting in an increasing pressure differential. As the pressure differential reaches a specific threshold (310), i.e., the breaking pressure of the valve (FIG. 1, 106), the valve (FIG. 1, 106) opens as indicated by the line (420) and fluid flows freely between the chambers and the pressure is equalized within the chambers (FIG. 1, 104-1, 104-2).

While FIGS. 4A and 4B depicts the pressure equalizing after the valve opens (FIG. 1, 106) at the line (420), the pressures may not equalize. For example, depending on the latency of the valve (FIG. 1, 106), the pressure difference may be maintained. However, due to the opening of the valves (FIG. 1, 106) the pressure difference between the two chambers is not going to be greater than the specific threshold (310). Note also how in FIGS. 4A and 4B neither backpressure (412-1, 412-2) is greater than the bad print quality pressure (318) and neither is less than the head pressure (316).

FIG. 5 is a diagram of a printer cartridge (100) with fluid chambers (104) in fluid communication, according to another example of the principles described herein. As described above, the printer cartridge (100) may include multiple backpressure chambers (102) in selective fluid communication with multiple fluid chambers (104). The backpressure chambers (102) to provide backpressure against the fluid to be deposited on a print medium and the fluid chambers (102) to provide fluid to a printhead.

The backpressure chambers (102-1, 102-2, 102-3) may be arranged in an array such that they span a width. For example, the array of backpressure chambers (102-1, 102-2, 102-3) may span the width of the print medium on which the fluid is to be deposited. For example if the print medium is 8.5 by 11 inch letter paper, the array of backpressure chambers (102) may be 8.5 inches wide.

Having an array of backpressure chambers (102) may reduce the amount of backpressure provided by each chamber. For example, in a page wide array, a single backpressure chamber would be designed to accommodate the pressure resulting from the entire width of the page-wide array which could be upwards of 8.5 inches of head. Providing such a backpressure is difficult as a foam material with small pores may be used, but inhibits fluid flow through the chamber (102), which inhibited flow affects print quality. In addition to being difficult to achieve, such high levels of backpressure also impact print quality as such a high backpressure may be more than can be overcome by an ejector of a printhead, thus resulting in misfiring or non-firing of the fluid droplet from the nozzle. Thus, in summary, segmented backpressure chambers (102) may reduce the amount of backpressure generated by each backpressure chamber (102).

The amount of backpressure provided by each backpressure chamber (102) may be dependent upon the width of the array of backpressure chambers (102) and the number of backpressure chambers (102). For example, if the width of the array of backpressure chambers (102) is 9 inches to accommodate a page-wide array for printing on 8.5×11 paper, and if there were three backpressure chambers (102) as indicated in FIG. 5, each backpressure may be designed to provide at least 3 inches of pressure, for example between 3-5 inches of pressure.

In this example, each fluid chamber (104) may be in fluid communication with a corresponding backpressure chamber (102). For example, the first fluid chamber (104-1) may be in fluid communication with the first backpressure chamber (102-1). Similarly, the second and third fluid chambers (104-2, 104-3) may be in fluidic communication with the second and third backpressure chambers (102-2, 102-3), respectively.

To provide the backpressure, the backpressure chambers (102) include a backpressure providing component. For example, the backpressure chambers (102) may include a foam insert disposed within the backpressure chambers (102) to regulate the pressure of the backpressure chamber (102). The foam insert via capillary action provides a backpressure that prevents nozzle spillage. In another example other forms of pressure regulating components may be implemented. For example, the backpressure chamber (104) includes a spring-bag assembly to regulate pressure within the backpressure fluid chamber (104).

Moreover as indicated in FIG. 5, multiple passageways (522) may exist between adjacent fluid chambers (102).

More specifically, as indicated above, in some examples a single valve (106) is disposed between adjacent fluid chambers (104). However, in other examples, multiple valves (106) regulate fluid flow between adjacent fluid chambers (104). Valves (106) disposed along the passageways (522) allow opening and closing of the passageways (522) to regulate fluid flow. As FIG. 5 is a front view, some of the passageways (522) and valves (106) are not visible. The multiple passageways (522) between adjacent fluid chambers (104) are more clearly indicated in FIG. 2. The passageways (522) and valves (106) may be uni-directional such that a first passageway (522) and valve (106) selectively allows fluid to flow in a first direction between adjacent fluid chambers (104) while a second passageway (522) and valve (106) selectively allow fluid to flow in a second direction between adjacent fluid chambers (104).

As depicted in FIG. 5, the passageways (522) and valves (106) may be located near a bottom of the fluid chambers (104) close to an outlet of the fluid chambers (104) from where the fluid passes from the fluid chambers (104) to the printhead. Doing so may ensure that fluid levels between the adjacent fluid chambers (104) may be equalized even at low levels.

In some examples, the printer cartridge (100) may include a main fluid supply and the backpressure chambers (102) may be selectively coupled via tubes or hoses, to the main fluid supply. As with the fluid chambers (104), fluid within the main fluid supply may flow freely without any impediment to flow. The main fluid supply may be at environmental pressure for example due to a vent that exposes the interior of the main fluid supply to ambient conditions. The multiple backpressure chambers (102) are in fluid communication with the main fluid supply.

In some examples, the printer cartridge (100) is a page wide printer cartridge for use with a page wide printhead. In other words, at least one of the array of the multiple backpressure chambers (102) and the array of the multiple fluid chambers (104) is the same width as the print medium. While specific reference is made to an array relative to the width of the paper, the array may also be relative to the length of the paper. A page-wide printer cartridge (100) alleviates lateral movement of either the print medium or the printer cartridge (100) when depositing printing fluid onto the print medium. This reduces the likelihood of breakdown due to the mechanical devices that would otherwise be used to move the printer cartridge (100). A page-wide printer cartridge also may result in faster print speeds and more consistent page movement. The examples shown in the corresponding figures are not meant to limit the present description. Instead, various types of printer cartridge (100) may be used in conjunction with the principles described herein.

Figure 6:
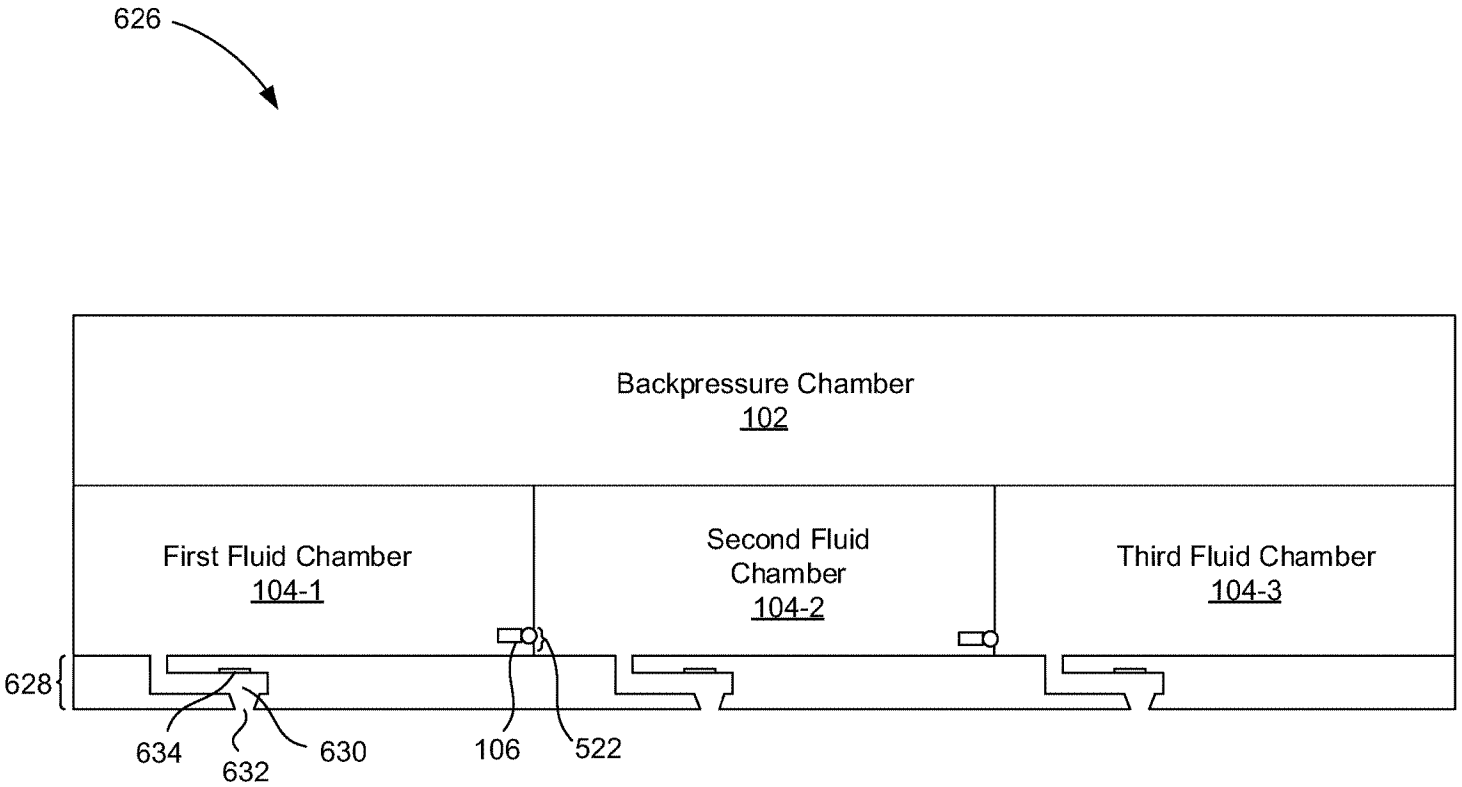
FIG. 6 is a diagram of a fluid delivery system with multiple fluid chambers in fluid communication, according to one example of the principles described herein.

FIG. 6 is a diagram of a fluid delivery system (626) with multiple fluid chambers (104) in fluid communication, according to one example of the principles described herein. The fluid delivery system (626) may include at least one backpressure chamber (102) and multiple fluid chambers (104) similar to those described above. The system (626) may also include multiple passageways (522) and valves (106) to selectively allow fluid flow between adjacent fluid chambers (104) as described above. For simplicity just a few of some of these components are indicated by a reference number.

The fluid delivery system (626) also includes a fluidic ejection device such as a printhead (628). The printhead (628) includes a number of components for depositing a fluid onto a surface. For example, the printhead (628) includes a number of printhead dies. Each printhead die includes a number of nozzles. The nozzles of the printhead dies may be arranged in columns or arrays such that properly sequenced ejection of fluid from the nozzles causes characters, symbols, and/or other graphics or images to be printed on the print medium. In one example, the number of nozzles fired may be a number less than the total number of nozzles available and defined on the printhead (628). As described above, each fluid chamber (104) may correspond to a different printhead die, or in other words a different portion of the printhead (628). In the description that follows, please note that for simplicity just a few of some of the components are identified with a reference number. Moreover, FIG. 6 is not to scale. For example, the nozzles depicted in FIG. 6 may be much smaller than the fluid chamber (104). Moreover, there may be more nozzles than depicted in FIG. 6. These components may not be drawn to scale or represent a specific quantity of the component but are representation of the concept that a fluid chamber passes fluid to a number of nozzles.

In an example where the fluid is an ink, a first subset of nozzles may eject a first color of ink while a second subset of nozzles may eject a second color of ink. Additional groups of nozzles may be reserved for additional colors of ink. To create an image, at appropriate times, electrical signals passed to the printhead (628) that cause the printhead (628) to eject small droplets of fluid from the nozzles onto the surface of the print medium. These droplets combine to form an image on the surface of the print medium. As used in the present specification and in the appended claims, the print medium may be any type of suitable sheet or roll material, such as paper, card stock, transparencies, polyester, plywood, foam board, fabric, canvas, and the like. In another example, the print medium may be an edible substrate.

Returning to the printhead die, a printhead die includes a number of nozzles to deposit an amount of fluid onto a print medium. The nozzles may be arranged in rows, columns, or other forms of arrays to deposit the fluid onto a print medium. For simplicity one nozzle per fluid chamber (104) is indicated however any number of nozzles in any orientation may be in fluidic communication with a corresponding fluid chamber (104). Each nozzle includes a firing chamber (630) to hold an amount of fluid received from the corresponding fluid chamber (104) to be dispensed out an opening (632).

A printhead die also includes an ejector (634) to eject the amount of fluid through the opening (632). For simplicity, in FIG. 6 one instance of certain components is identified with a reference number. The ejector (634) may include a firing resistor or other thermal device, a piezoelectric element, or other mechanism for ejecting fluid from the firing chamber (630). For example, the ejector (634) may be a firing resistor. The firing resistor heats up in response to an applied voltage. As the firing resistor heats up, a portion of the fluid in the firing chamber (630) vaporizes to form a bubble. This bubble pushes liquid fluid out the opening (632) and onto the print medium. As the vaporized fluid bubble pops, a vacuum pressure within the firing chamber (630) draws fluid into the firing chamber (630) from the fluid supply, and the process repeats. In this example, the printhead (628) may be a thermal inkjet printhead (628).

In another example, the ejector (634) may be a piezoelectric device. As a voltage is applied, the piezoelectric device changes shape which generates a pressure pulse in the firing chamber (630) that pushes a fluid out the opening and onto the print medium. In this example, the printhead (628) may be a piezoelectric inkjet printhead Certain examples of the present disclosure are directed to printer cartridges and fluid delivery systems that have fluid chambers that are in fluidic communication with adjacent fluid chambers that provides a number of advantages not previously offered including 1) accommodating greater head pressures found in certain print heads; 2) allowing for larger fluid container design; and 3) reducing stranded fluid caused by uneven printing along a page wide print head. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printer cartridge comprising:

at least one backpressure chamber to provide backpressure to a fluid during deposition of the fluid onto a print medium; and multiple fluid chambers in fluid communication with the at least one backpressure chamber, wherein:

each fluid chamber provides the fluid to a different portion of a printhead;

adjacent fluid chambers are selectively in fluid communication with one another via at least one valve.

2. The printer cartridge of claim 1, wherein the fluid is ink and the printer cartridge is an inkjet cartridge.

3. The printer cartridge of claim 1, comprising multiple backpressure chambers corresponding to the multiple fluid chambers.

4. The printer cartridge of claim 3, wherein:

at least one of the multiple backpressure chambers and the multiple fluid chamber are arranged in an array; and the array is the same width as the print medium on which the fluid is deposited.

5. The printer cartridge of claim 1, wherein the at least one valve is opened as a difference in pressure in the adjacent fluid chambers exceeds a breaking pressure for the at least one valve.

6. The printer cartridge of claim 1, wherein a breaking pressure for the at least one valve is such that the pressure in any of the multiple fluid chambers is greater than a head pressure.

7. The printer cartridge of claim 1, wherein a breaking pressure for the at least one valve is such that the pressure in any of the multiple fluid chambers is less than a bad print quality pressure.

8. The printer cartridge of claim 1, wherein a breaking pressure for the valves is equal to the length of the printer cartridge divided by the number of fluid chambers.

9. The printer cartridge of claim 1, wherein the at least one valve opens in response to a pressure differential between adjacent fluid chambers exceeding a breaking pressure and closes when the pressure differential between the adjacent fluid chambers is reduced below the breaking pressure.

10. The printer cartridge of claim 9, wherein the breaking pressure of the valve is 3-5 inches of water.

11. The printer cartridge of claim 1, comprising multiple backpressure chambers, a different backpressure chamber being in selective fluid communication each of the fluid chambers.

12. The printer cartridge of claim 1, wherein the backpressure chamber comprises a spring-bag assembly to regulate pressure within the backpressure chamber.

13. The printer cartridge of claim 1, wherein a passageway between adjacent fluid chambers that is regulated by the at least one valve is disposed at a bottom of the adjacent fluid chambers so that fluid levels between the adjacent chambers may be equalized even at low levels.

14. A fluid delivery system comprising:

at least one backpressure chamber to provide backpressure to a fluid during deposition of the fluid onto a print medium; and multiple fluid chambers disposed adjacent to each other laterally along a width of a printhead, each fluid chamber being in fluid communication with the at least one backpressure chamber, wherein a fluid chamber comprises at least one passageway connecting the fluid chamber to adjacent fluid chambers;

a valve disposed in a passageway to regulate fluid flow between adjacent fluid chambers; and the printhead to transfer the fluid from the multiple fluid chambers onto a print medium.

15. The printer cartridge of claim 14, wherein the printhead comprises a number of print dies, each print die comprising number of nozzles to deposit an amount of fluid onto a print medium, each nozzle comprising:

a firing chamber to hold the amount of fluid;

an opening to dispense the amount of fluid onto the print medium; and an ejector to eject the amount of fluid through the opening.

16. The fluid delivery system of claim 14, wherein a backpressure chamber includes a foam insert disposed within the backpressure chamber to regulate the pressure of the backpressure chamber.

17. The fluid delivery system of claim 14, wherein a first valve allows fluid flow through a corresponding passageway from a first fluid chamber to a second fluid chamber and a second valve allows fluid flow through a corresponding passageway from a second fluid chamber to a first fluid chamber.

18. The fluid delivery system of claim 14, wherein the fluid delivery system is selectively coupled to a fluid supply.

19. A printer cartridge comprising:

multiple backpressure chambers to provide backpressure to the fluid during deposition of the fluid onto a print medium; and multiple fluid chambers, each of the fluid chambers in fluid communication with one of the multiple backpressure chambers to provide fluid to a printhead;

wherein each of the fluid chambers includes:

a first passageway and valve to selectively allow fluid flow in a first direction between adjacent fluid chambers; and a second passageway and valve to selectively allow fluid flow in a second direction between adjacent fluid chambers;

wherein at least one of an array of the multiple backpressure chambers and an array of the multiple fluid chambers are the same width as a print medium.

20. The printer cartridge of claim 19, wherein the first passageway and valve and the second passageway and valve are near an outlet of the fluid chamber near the printhead.

* * * * *